United States Patent [19]

Morozumi et al.

[11] Patent Number: 5,026,264

[45] Date of Patent: Jun. 25, 1991

[54] FLUID COMPRESSOR

[75] Inventors: Naoya Morozumi, Machida; Hirotsugu Sakata, Chigasaki; Makoto Hayano, Tokyo; Masayuki Okuda; Takayoshi Fujiwara, both of Kawasaki; Moriaki Shimoda, Yokohama; Hitoshi Hattori, Fuji, all of Japan

[73] Assignee: Kabushiki Kaisha Toshiba, Kawasaki, Japan

[21] Appl. No.: 472,177

[22] Filed: Jan. 30, 1990

[30] Foreign Application Priority Data

Jan. 31, 1989 [JP] Japan ..... 1-21096

[51] Int. Cl.[5] ..... F04B 29/00

[52] U.S. Cl. ..... 418/220; 418/172; 418/55.1; 417/356

[58] Field of Search ..... 418/220, 172, 94, 55.1; 417/356

[56] References Cited

U.S. PATENT DOCUMENTS 2,401,189 5/1946 Quiroz .

4,871,304 10/1989 Iida et al. ..... 417/356

4,875,842 10/1989 Iida et al. ..... 417/356

*Primary Examiner*—Leonard E. Smith

*Assistant Examiner*—Peter Korytnyk

*Attorney, Agent, or Firm*—Cushman, Darby & Cushman

[57] ABSTRACT

A fluid compressor includes a cylinder and a columnar rotary rod. The rod is arranged in the cylinder so as to extend in the axial direction thereof and be eccentric thereto, and orbitable relative to the cylinder without rotation with respect to the cylinder while part of the rod is in contact with the inner circumferential surface of the cylinder. A spiral groove is formed on the outer circumference of the rod and a spiral blade is fitted in the groove. The space between the outer circumference surface of the rod and the inner circumference surface of the cylinder is divided by the blade into a plurality of operating chambers. The groove has an overall length larger than that of the blade by a predetermined length so that the blade is displaceable relative to the rod in the radial and circumferential directions of the rod without sliding on the inner circumferential of the cylinder.

4 Claims, 5 Drawing Sheets

FLUID COMPRESSOR

BACKGROUND OF THE INVENTION

1. Field of the Invention

The present invention relates to a fluid compressor for compressing, e.g., a refrigerant gas in a refrigeration cycle and, more particularly, to a fluid compressor having a spiral blade.

2. Description of the Related Art

Various conventional compressors such as reciprocating and rotary compressors are known. In these compressors, however, the structures of drive units such as crank shafts for transmitting rotational forces to compression units, as well as the structures of the compression units themselves, are complicated, and a large number of components are required. In addition, in order to obtain high compression efficiency, a check valve must be disposed at the discharge side thereof. However, the pressure difference between the inlet and outlet sides of the check valve is large, with the result that gas tends to leak from the check valve. Thus, any conventional compressor has low compression efficiency. In order to solve this problem, dimensional precision of the respective components as well as assembly precision must be improved and, as a consequence, manufacturing costs become high.

In recent years, in order to solve the above problem, there has been provided a fluid compressor having a spiral blade.

A compressor of this type comprises a cylinder, and a rotary rod eccentrically arranged in the cylinder and orbitable relative thereto. A spiral groove is formed on the outer circumferential surface of the rod, along almost the entire length thereof. A spiral blade is fitted in the spiral groove. The outer circumferential surface of the blade is in tight contact with the inner circumferential surface of the cylinder The spiral blade slides in the spiral groove, in the radial direction of the rod, upon the orbital movement of the rod relative to the cylinder.

The space between the rod and the cylinder is partitioned into a plurality of spaces by the blade. The pitches of the spiral groove are gradually narrowed with a distance from one end of the rod. For this reason, the volumes of the plurality of spaces gradually decrease from one end of the rod to the other. Therefore, a fluid flowing from one end of the rod into the spaces is conveyed to the other end of while being confined in the spaces. During this conveyance, the fluid is gradually compressed and finally delivered from the other end of the rod.

In the fluid compressor having the above structure, the overall length of the spiral groove is equal to that of the blade. Each end of the blade abuts against the corresponding end of the groove. For this reason, during the operation of the compressor, the blade is rotated integral with the rod. Since the rod is located eccentric to the cylinder, the speed at which its outer circumference moves is different from the speed at which the inner circumference of the cylinder moves, except at the start of each rotation of the rod and the cylinder. Therefore, the outer circumferential surface of the blade reciprocally slides on the inner circumferential surface of the cylinder in the circumferential direction.

Sliding movement between the blade and the cylinder occurs along the entire length of the blade. A large friction loss occurs between the blade and the cylinder and, as a result, the operation efficiency of the compressor is degraded.

SUMMARY OF THE INVENTION

The present invention has been made in consideration of the above situation, and its object is to provide a fluid compressor having little friction loss between the blade and the cylinder and high operating efficiency.

In order to achieve the above object of the present invention, there is provided a fluid compressor comprising: a cylinder having a suction-side end and a discharge-side end; a columnar rotary member which is eccentrically arranged in the cylinder so as to extend in the axial direction thereof, and orbitable without rotation relative to the cylinder while part of the rotary member is in contact with the inner circumferential surface of the cylinder, the rotary member having a spiral groove formed on the outer circumferential surface thereof, the spiral groove having pitches gradually narrowed with a distance from the suction-side end of the cylinder; a spiral blade fitted in the spiral groove and slidable in the radial direction of the rotary member having an outer circumferential surface being in tight contact with the inner circumferential surface of the cylinder, and partitioning the space between the inner circumferential surface of the cylinder and the outer circumferential surface of the rotary member into a plurality of operating chambers; and drive means for orbitting the cylinder and the rotary member relative to each other, thereby continuously transferring a fluid, which is introduced from the suction-side end of the cylinder into the cylinder, through the operating chambers toward the discharge-side operating chambers, and delivering the fluid from the discharge-side end of the cylinder. The overall length of the groove is larger than that of the blade so that the blade is displaceable relative to the rotary member in the circumferential direction of the cylinder.

In the fluid compressor having the above structure, a gap is formed between the end of the groove and the end of the blade. For this reason, the movement of the blade is not restricted by the rotation of the rotary member and can orbit within the groove. Therefore, the blade does not slide on the inner circumferential surface of the cylinder and is rotated together with the cylinder.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 8E show a fluid compressor according to an embodiment of the present invention, in which:

FIG. 1 is a sectional view showing the overall structure of the compressor;

FIG. 2 is an exploded side view showing a compression section;

FIG. 3 is a perspective view showing a rotary rod and a blade;

FIG. 4 is a sectional view of the fluid compressor taken along the line IV—IV of FIG. 1;

FIG. 5 is a sectional view of the fluid compressor taken along the line V—V of FIG. 1;

FIG. 6 is a sectional view of the fluid compressor taken along the line VI—VI of FIG. 1;

FIGS. 8A to 8E are views showing the compression processes of a refrigerant gas.

DETAILED DESCRIPTION OF THE PREFERRED EMBODIMENT

An embodiment of the present invention will be described in detail, with reference to the accompanying drawings.

Figure 1:
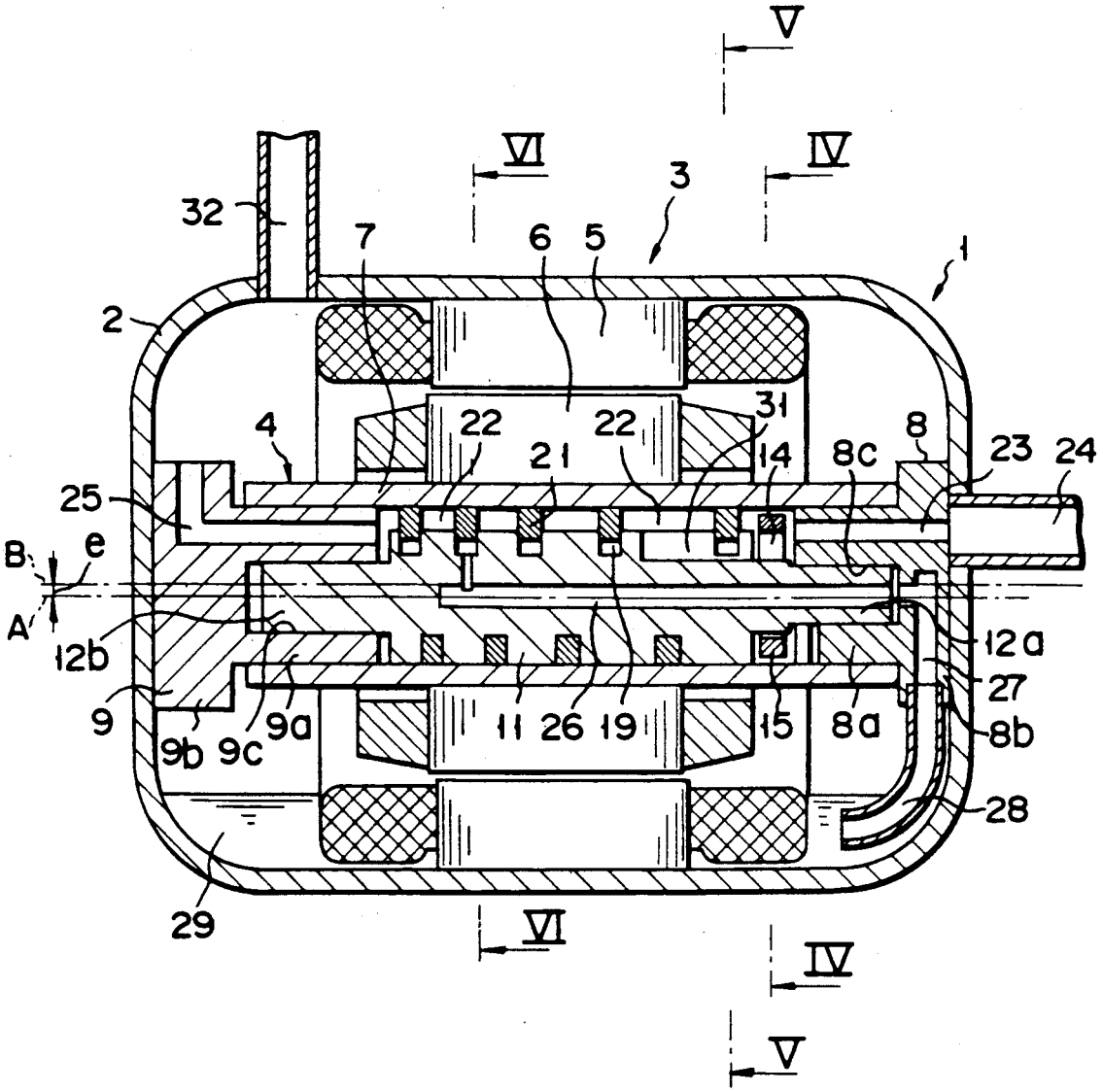

FIG. 1 shows an embodiment according to which the present invention is applied to a closed-type compressor for compressing a refrigerant of a refrigeration cycle.

The compressor comprises a closed case 2, an electric motor section 3, and a compression section 4 which are housed in the case 2. The electric motor section 3 comprises a substantially annular stator 5, fixed on the inner surface of the case 2, and an annular rotor 6 arranged inside the stator 5.

The compression section 4 comprises a cylinder 7, on the outer circumferential surface of which the rotor 6 is coaxially fixed. Both ends of the cylinder 7 are rotatably supported by bearings 8 and 9 fixed on the inner surface of the case 2 and are air-tightly closed thereby In particular, the right end portion (i.e., the suction end portion) of the cylinder 7 is rotatably supported by the bearing 8, and the discharge end portion, i.e., the left end portion of the cylinder 7, is rotatably supported by the bearing 9. The bearings 8 and 9 respectively comprise boss portions 8*a* and 9*a* rotatably inserted in the end portions of the cylinder 7 and base portions 8*b* and 9*b* fixed on the inner surface of the case 2 and each having a diameter larger than that of the corresponding boss portion. The cylinder 7 and the rotor 6 mounted on the cylinder 7 are supported coaxially with the stator 5 by the bearings 8 and 9.

A columnar rotary rod 11, having its diameter smaller than the inner diameter of the cylinder 7, is arranged in the cylinder and extends along the axis thereof. The rod 11 is made of a metal such as an iron-based metal. The axis A of the rod 11 is eccentric relative to the axis B of the cylinder 7 by a distance e. Part of the outer circumferential surface of the rod 11 is in linear contact with the inner circumferential surface of the cylinder Support shafts 12*a* and 12*b* extend from either end portion of the rotary rod 11. The support shafts 12*a* and 12*b* are rotatably inserted into bearing holes 8*c* and 9*c* formed in the bearings 8 and 9.

As shown in FIGS. 1 to 4, a prism portion 13 having a square cross section is formed on the support shaft 12*a*. An Oldham ring 15 having a rectangular elongated hole 14 is mounted on the prism portion 13. That is, the prism portion 1 is inserted into the elongated hole 14 of the ring 15, and the ring 15 is slidable on the portion 13 along the longitudinal axis of the elongated hole 14. A pair of through-holes, extending in a direction perpendicular to the longitudinal axis of the hole and in the radial direction of the ring, are formed in the ring 15, and one end of each of pins 16 are fitted in these through holes. The other end portions of the pins 16 are respectively fixed in through holes 17 formed in the cylinder 7. The outer ends of the through holes 17 are sealed by caps 18, respectively.

The rod 11 is supported by the ring 15 so as to be movable in the radial direction of the cylinder 7. When the electric motor section 3 is energized to rotate the rotor 6 together with the cylinder 7, the rotational force of the cylinder is transmitted to the rotary rod 11 through the Oldham ring 15. Therefore, the rod 11 is rotated in the cylinder while part of the rod 11 is in contact with the inner circumferential surface of the cylinder 7, and orbits relative to the cylinder 7.

Figure 2:
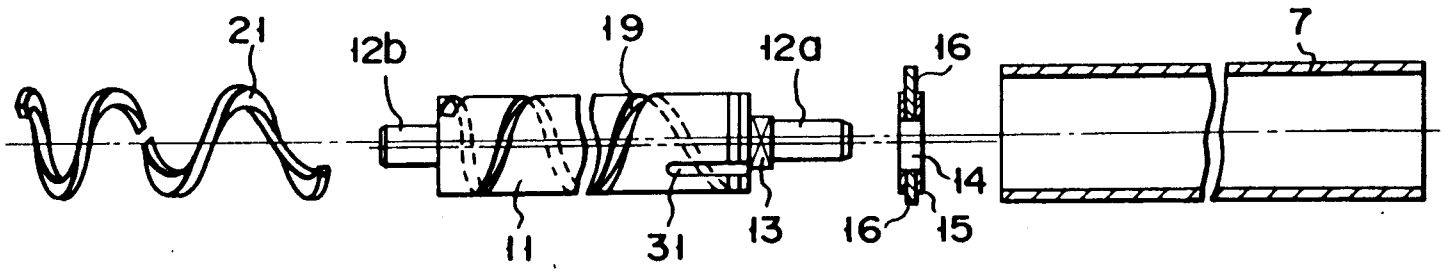
Figure 3:
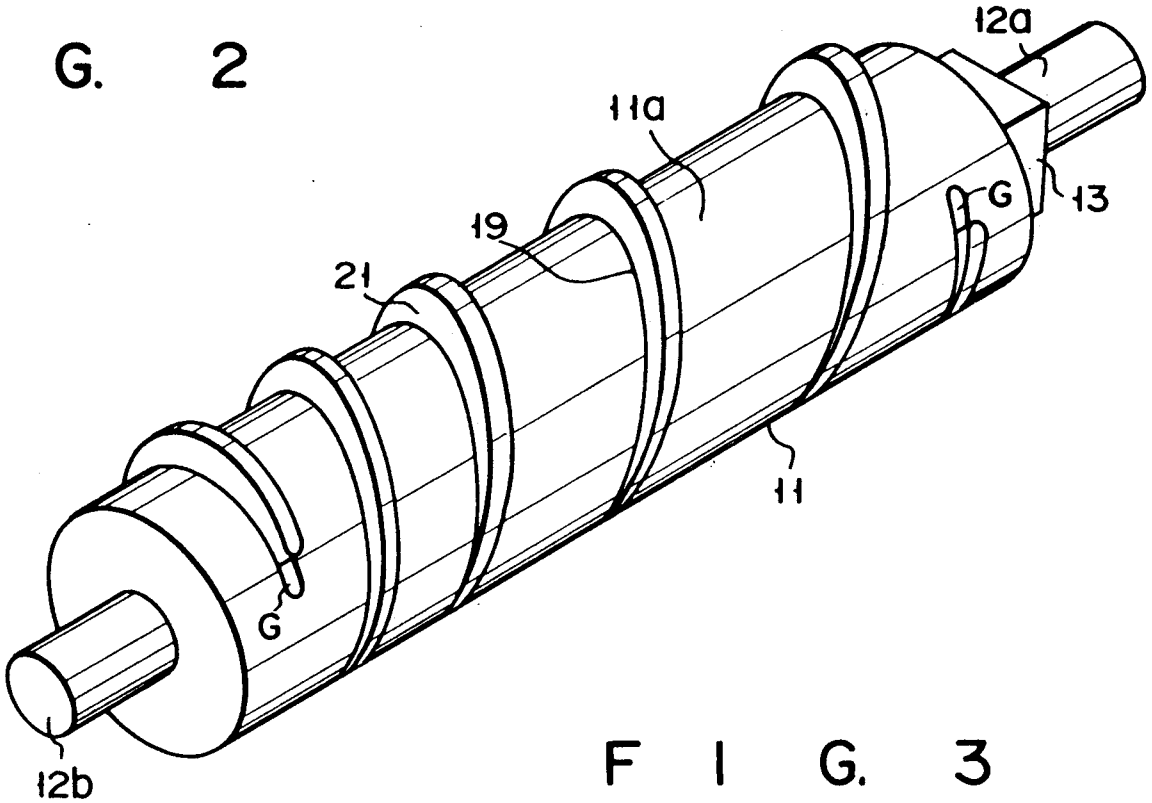
Figure 4:
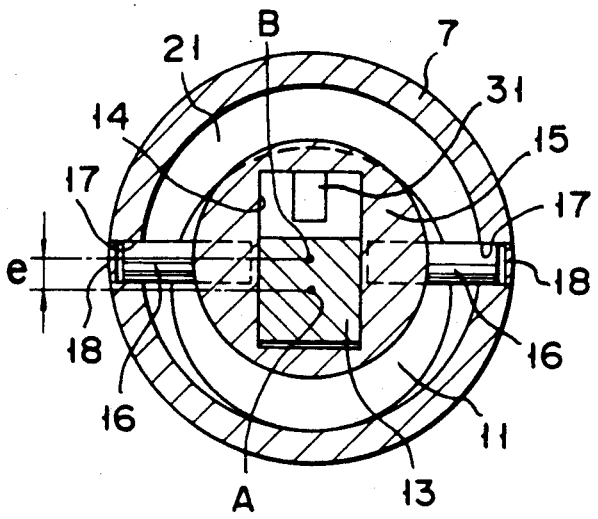
Figure 5:
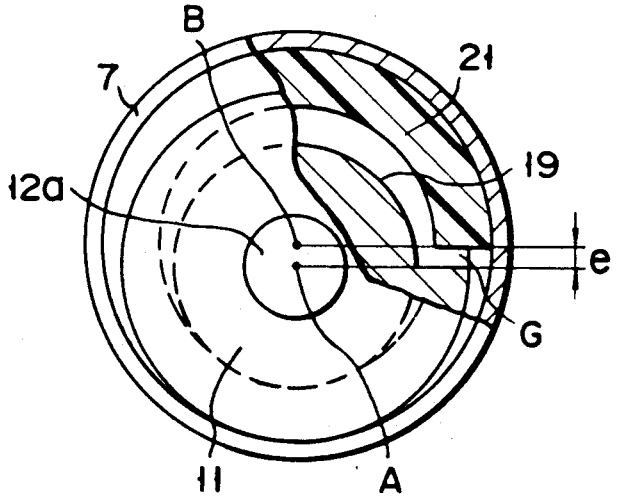

As shown in FIGS. 1 to 3, a spiral groove 19 is formed on the outer circumferential surface of the rotary rod 11 so as to extend between both ends of the rod 11. The pitches of the groove 19 are gradually reduced with a distance from the right end of the cylinder 7 to the left end thereof, i.e., from the suction-side end of the cylinder to the discharge-side end thereof The overall length of the groove 19 is larger than that of a blade 21 (to be described later). When the rod 11 is assembled in the cylinder 7, each gap G is formed between the corresponding ends of the groove 19 and the blade 21, as shown in FIGS. 3 and 5.

Each gap G is formed to allow relative movement, especially orbital movement, of the blade 21 with respect to the rod 11. The total length of the two gaps G is set to be twice or more of the eccentric amount e of the rod 11 with respect to the cylinder 7. The total length of the gaps G may not be accurately twice the eccentric amount e but may often be twice or less due to, for example, thermal expansion of the blade 21. Therefore, the total length is set to be about twice or more of the eccentric amount e, in consideration of the above case.

The spiral blade 21 shown in FIGS. 2 and 3 is fitted in the groove 19 of the rod 11. The blade 21 is made of an elastic material such as a synthetic resin, and is forcibly screwed and fitted into the groove 19 by utilizing its elasticity. The thickness of the blade 21 is substantially equal to the width of the groove 19. Both ends of the blade 21 are located on a plane perpendicular to the axis of the rod 11 and oppose the corresponding ends of the groove 19 with the corresponding gaps G therebetween. Note that the blade 21 may be fitted in the groove 19 such that one end of the blade is matched with the corresponding end of the groove, i.e. a gap of 2G is formed at one end of the blade. Each portion of the blade 21 is movable along the groove 19 along the radial direction of the rotary rod 11. The outer circumferential surface of the blade 2 is in contact with the inner circumferential surface of the cylinder 7.

Figure 6:
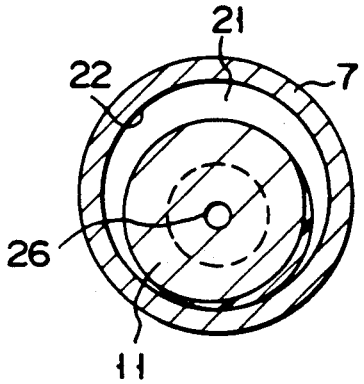

As shown in FIG. 1, the space between the inner circumferential surface of the cylinder 7 and the outer circumferential surface of the rod 11 is partitioned into a plurality of operation chambers 22 by the blade 21. Each operation chamber 22 is defined between two adjacent turns of the blade 21. As shown in FIG. 6, each working chamber 22 has a substantially crescent-like shape, extending from one contact portion between the rod 11 and the inner circumferential surface of the cylinder 7 to the next contact portion. The volumes of the working chambers 22 are gradually reduced from the suction-side end of the cylinder 7 to the discharge-side end thereof.

As shown in FIG. 1, a suction hole 23, parallel to the axis of the cylinder 7, is formed in the bearing 8 which supports the suction-side end of the cylinder 7. One end of the hole 23 is open into the cylinder at its suction end, and the other end of the hole 23 is connected to a suction tube 24 of the refrigeration cycle. A discharge port 25 is formed in the bearing 9 which supports the discharge-side end of the cylinder 7. One end of the port 25 is open into the cylinder 7 at its delivery end, and the other end of the port 25 is open to the inside of the case 2. Note that the discharge port 25 may be formed in the cylinder 7.

An oil supply path 26 is formed inside the rod 11 end extends from the right end to an intermediate portion thereof. The right end of the path 26 communicates with the interior of the case 2, particularly the bottom portion thereof, through a path 27 formed in the bearing 8, and a supply tube 28. The left end of the path 26 is open to the bottom of the groove 19 formed in the rod 11. A lubricant 29 is stored in the bottom of the case 2 and, when the pressure in the case 2 is increased, the lubricant 29 is supplied to the space between the bottom of the groove 19 and the blade 21 through the tube 28 and the paths 27 and 26.

As shown in FIGS. 1 and 2, a suction groove 31 is formed on the outer circumferential surface of the suction end of the rotary rod 11. The groove 31 axially extends along the rod 11 and has a depth larger than that of the spiral groove 19. One end of the groove 31 is open to the end face of the rod 11, and the other end of the groove 31 extends to a position where the groove 31 can communicate with the first operating chamber located at the suction-side end of the cylinder 7. For this reason, the refrigerant gas introduced from the suction tube 24 to the cylinder 7 is properly supplied to the first operating chamber 22 through the suction groove 31 without interruption.

Reference numeral 32 in FIG. 1 denotes a discharge tube communicating with the interior of the case 2.

The operation of the compressor having the above arrangement will be described.

When the electric motor unit 3 is energized, the rotor 6 is rotated, and the cylinder 7 is rotated together with the rotor 6. At the same time, the rotary rod 11 is rotated while its outer circumferential surface is partially in contact with the inner circumferential surface of the cylinder 7. Relative orbital movement between the rod 11 and the cylinder 7 is assured by transmitting means, i.e. the Oldham ring 15 mounted on the prism portion 13 of the rod 11.

A portion of the blade 21 is urged toward the outer circumferential surface of the cylinder 7 by the pressure of the lubricant supplied to the bottom of the spiral groove 19 through the oil supply path 26, and the outer circumferential surface of the blade is in tight contact with the inner circumferential surface of the cylinder 7. For this reason, the friction force between the blade 21 and the cylinder 7 is larger than that between the blade and the rod 11. Thus, the blade 21 is rotated while its outer circumferential surface is in contact with the inner circumferential surface of the cylinder 7, and the respective parts of the blade 21 orbit with respect to the rod 11.

Figure 7A:
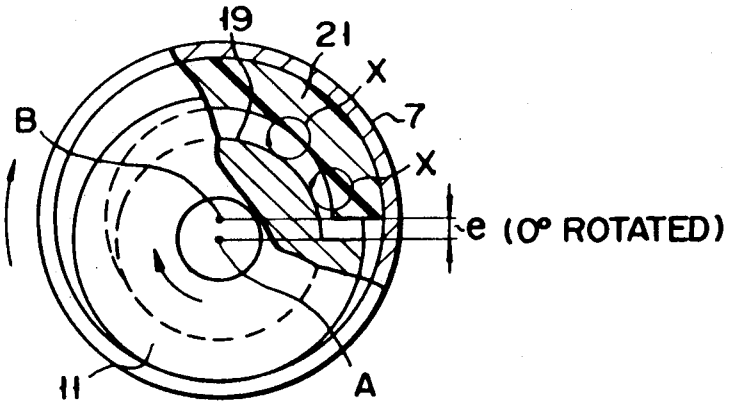
FIGS. 7A to 7D are sectional views showing relative positions between the cylinder, the rotary member, and the blade during the compression processes.
Figure 7B:
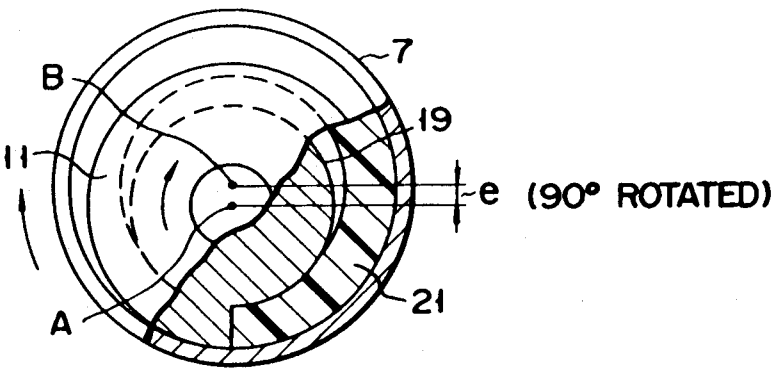
Figure 7C:
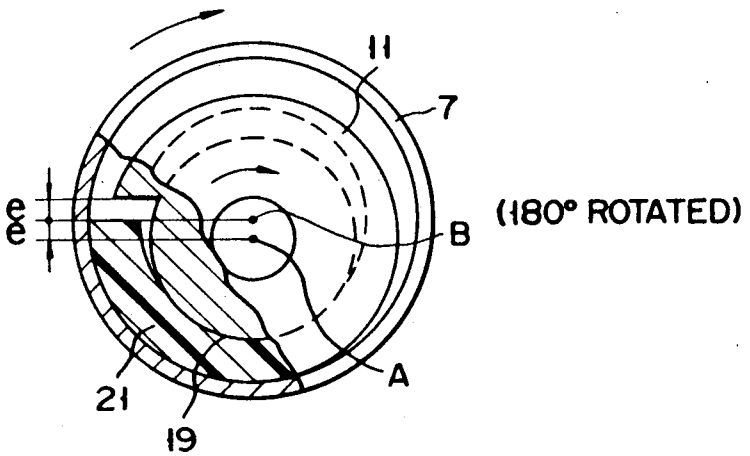
Figure 7D:
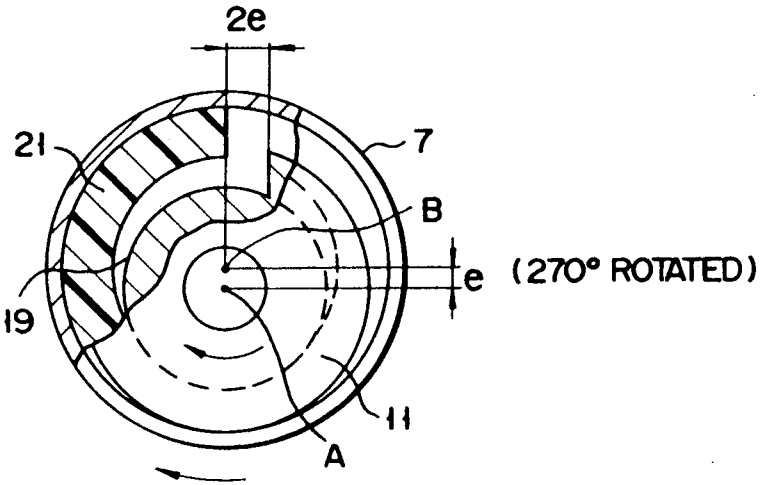
Figure 8A:
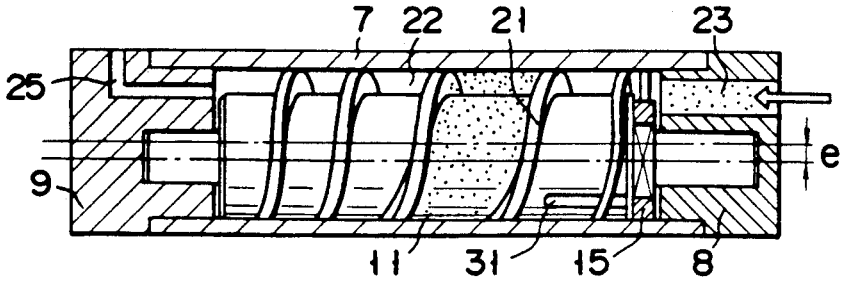
Figure 8B:
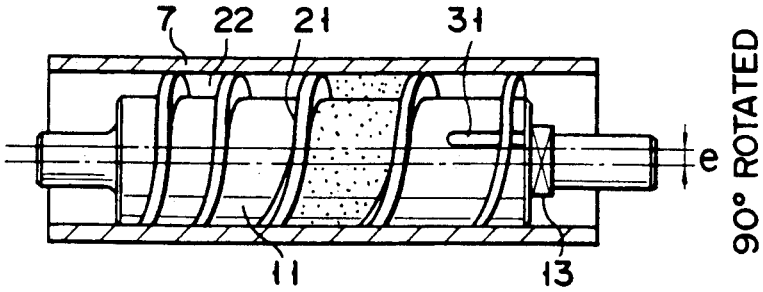
Figure 8C:
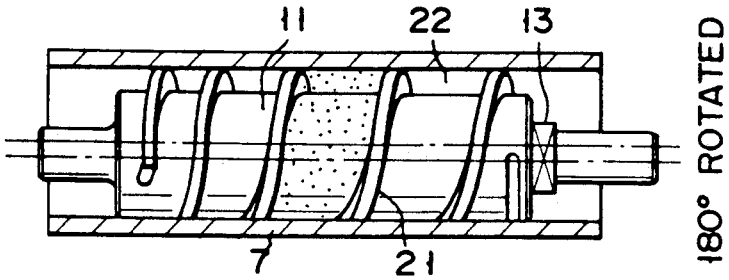
Figure 8D:
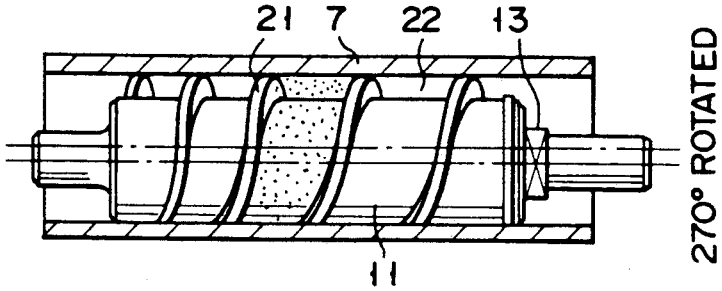
Figure 8E:
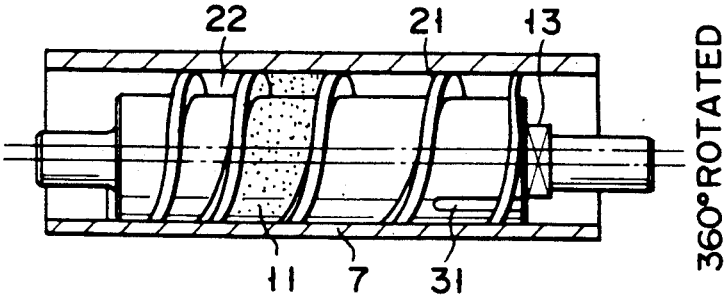

More specifically, as shown in FIGS. 7A to 7D, each part of the blade 21 is pushed into the groove 19 when it approaches each contact portion between the outer circumferential surface of the rod 11 and the inner circumferential surface of the cylinder 7, and emerges from the groove when it goes away from the contact portion. That is, each part of the blade 21 moves radially, relative to the cylinder 7. At the same time, the overall length of the spiral groove 19 is larger than the overall length of the blade by a predetermined length. Therefore, each part of the blade 21 moves both in the radial direction of the cylinder 7 and in the circumferential direction of the cylinder 7, relative to the rod 11. More specifically, as shown in FIG. 7A, a position where the end of the blade 21 is spaced apart from the end of the groove 19 by the distance e is defined as the start position. As shown in FIG. 7B, when the rod 11 and the cylinder 7 are rotated clockwise through 90° from the start position, the blade 21 moves, relative to the rod 11, in one direction along the circumference of the cylinder 7 by the predetermined distance e. As shown in FIG. 7C, when the rod 11 and the cylinder 7 are further rotated through 90°, the blade 21 moves in the opposite direction by the distance e, with respect to the rod 11. When the cylinder 7 and the rod 11 are rotated through another 90°, as shown in FIG. 7D, the blade 21 further moves in the opposite direction by the distance e, with respect to the rod 11. Therefore, the end of the blade 21 is spaced apart from the end of the groove 19 by a distance 2*e*. Subsequently, when the rod 11 and the cylinder 7 are rotated through 90°, as shown in FIG. 7A, the blade 21 moves in the above-described one direction by the distance e, with respect to the rod 11, thus returning to its start position.

Each part of the blade 21 is reciprocated by the distance 2*e* in the circumferential direction of the cylinder 7, relative to the rod, while the rod 11 and the cylinder 7 are rotated once. By the combination of the reciprocal movement and the radial movement of the blade 21, each part of the blade 21 orbits with respect to the rod 11, as indicated by arrows X in FIG. 7A. Further, the blade 21 is rotated together with the cylinder 7 without sliding on the cylinder.

When the compression section 4 is operated, the refrigerant gas is sucked into the cylinder 7 through the suction tube 24 and the suction hole 23. This gas flows through the supply groove 31 and is confined in the first operating chamber 22 located at the foremost suction-side end of the cylinder 7. As shown in FIGS. 8A to 8E, the gas is transferred to the dischargeside operating chambers while it is confined between the two adjacent turns of the blade 21 upon rotation of the rotary rod 11. The volumes of the chambers 22 are gradually reduced with a distance from the suction-side end of the cylinder 7 to the discharge-side end thereof, thus the refrigerant gas is gradually compressed while being transferred to the discharge side. The compressed refrigerant gas is delivered from the discharge port 25 formed in the bearing 9 to the interior of the case 2, and returned to the refrigeration cycle through the discharge tube 32.

When the internal pressure of the case 2 is increased by the discharged refrigerant gas, the lubricant 29 stored inside the case 2 is compressed and supplied to the space between the bottom of the spiral groove 19 and the blade 21 through the path 26. For this reason, the blade 21 is urged away from the groove 19, i.e., toward the inner circumferential surface of the cylinder 7. Therefore, the outer circumferential surface of the blade 21 is always held in tight contact with the inner circumferential surface of the cylinder 7. As a result, gas leakage between the adjacent operating chambers 22 can be reliably prevented.

With the compressor having the above arrangement, the pitches of the groove 19 formed on the rotary rod 11 are gradually reduced from the suction side to the delivery side of the cylinder 7. That is, the volumes of the operating chambers 22 are gradually reduced with a distance from the suction side. The refrigerant gas can be compressed while it is being transferred from the suction side to the delivery side of the cylinder 7 through the operating chambers 22. Since the refrigerant gas is transferred and compressed while it is confined in the operating chambers 22, the gas can be efficiently compressed even if no discharge valve is arranged on the discharge side of the compressor.

Since there is no need of a discharge valve, the arrangement of the compressor can be simplified, and the number of components of the compressor can be reduced. Since the rotor 6 of the electric motor section 3 is supported by the cylinder 7 of the compression section 4, the rotating shaft and bearings for supporting the rotor need not be especially provided. Therefore, the structure of the compressor can be further simplified, and the number of components of the compressor can be further reduced.

The cylinder 7 and the rod 11 are in contact with each other while they rotate in the same direction. For this reason, the friction between these two members is so small that they can rotate smoothly with less vibrations and noises.

The overall length of the spiral groove 19 is larger than that of the blade 21 by the distance **2*e* so that the blade 21 can be circumferentially moved with respect to the rotary rod 11. For this reason, each part of the blade 21 can orbit relative to the rod 11 without sliding on the cylinder 7. Therefore, the friction loss caused by sliding contact between the cylinder 7 and the rod 11 can be greatly reduced. In particular, the contact area of the blade 21 on the rod 11 is much smaller than that on the cylinder 7. Therefore, as compared with the case wherein the blade slides along the inner circumferential surface of the cylinder, the friction loss of the compression section 4** can be greatly reduced. As a result, the operating efficiency of the compressor can be improved The present invention is not limited to the particular embodiment described above. Various changes and modifications may be made within the spirit and scope of the invention. For example, the present invention is also applicable to other compressors in addition to a compressor combined with a refrigeration cycle.

In the embodiment described above, the difference in length between the spiral groove 19 and the blade 21 is **2*e*. However, this difference is not limited to 2*e*. More specifically, this difference is determined in accordance with the positional relation which the ends of the blade 21 have on the circumference of the rod 11, or with the position which the rod 11 takes with respect to the cylinder 7. Therefore, in order to prevent the blade 21 from moving along with the rod 11, it is only required that the blade 21 is shorter than the spiral groove 19 so that the blade 21 moves in the groove 19**, both in the radial direction and in the circumferential direction.

Additional advantages and modifications will readily occur to those skilled in the art. Therefore, the invention in its broader aspects is not limited to the specific details, representative devices, and illustrated examples shown and described. Accordingly, departures may be made from such details without departing from the spirit or scope of the general inventive concept as defined by the appended claims and their equivalents.

What is claimed is:

1. A fluid compressor comprising;

a cylinder having a suction-side end and a discharge-side end, said cylinder having an inner circumferential surface;

supporting means for rotatably supporting the suctionside and discharge-side end of said cylinder;

a columnar rotary member, having an outer circumferential surface, arranged in said cylinder so as to extend in the axial direction of said cylinder and be eccentric thereto, said rotary member having two axial ends rotatably supported by said supporting means, and being orbitable relative to said cylinder without rotation with respect to the cylinder while part of said rotary member is in contact with said inner circumferential surface of said cylinder, said rotary member having a spiral groove formed on said outer circumferential surface thereof, said spiral groove having pitches gradually narrowing with a distance from said suction-side end to said discharge-side end of said cylinder;

a spiral blade fitted in said spiral groove so as to be slidable in the radial direction of said rotary member, said spiral blade having an outer circumferential surface which is in tight contact with the inner circumferential surface of said cylinder and dividing the space between said inner circumferential surface of said cylinder and said outer circumferential surface of said rotary member into a plurality of operating chambers, said groove having an overall length larger than that of said blade by a predetermined length so that said blade is displaceable relative to said rotary member in the circumferential of direction the rotary member, and drive means for rotating said cylinder and said rotary member, thereby continuously transferring a fluid, introduced into the operating chambers from the suction-side end of said cylinder, toward the discharge-side end of the cylinder through said operating chambers, and delivering the fluid from the discharge-side end of said cylinder, said drive means having means for rotating said cylinder, and means for transmitting the rotational force of said cylinder to said rotary member so as to rotate said rotary member in synchronism with said cylinder.

2. A compressor according to claim 1, which further comprises means for urging the blade toward the inner circumferential surface of the cylinder.

3. A compressor according to claim 2, wherein said urging means comprises a case for enclosing the cylinder and storing the fluid discharged from the cylinder, a lubricant stored in the case and means for supplying the lubricant into a space between the blade and the bottom of the groove.

4. A compressor according to claim 1, wherein said drive means comprises an electric motor section for rotating the cylinder, and means for transmitting the rotational force of the electric motor section to the rotary member so as to rotate the rotary member in synchronism with the cylinder.

* * * * *